US006510305B1

(12) United States Patent
Franzen et al.

(10) Patent No.: US 6,510,305 B1
(45) Date of Patent: Jan. 21, 2003

(54) TONER TRANSPORT APPARATUS USING FLEXIBLE AUGERS

(75) Inventors: James J. Franzen, Fairport, NY (US); Jan M. Enderle, Rochester, NY (US); Wayne D. Drinkwater, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/723,686

(22) Filed: Nov. 28, 2000

(51) Int. Cl.[7] ..... G03G 15/08

(52) U.S. Cl. ..... 399/258; 222/DIG. 1; 399/256

(58) Field of Search ..... 399/254, 255, 399/256, 258; 222/DIG. 1

(56) References Cited

U.S. PATENT DOCUMENTS 3,550,556 A * 12/1970 Chawda ..... 399/256 X
4,101,211 A * 7/1978 Kayson ..... 399/256 X
4,142,655 A * 3/1979 Fantuzzo ..... 222/DIG. 1
4,163,614 A 8/1979 Vock ..... 355/3 DD
4,442,789 A * 4/1984 Pirwitz ..... 399/258 X
4,813,531 A 3/1989 Tannascoli et al. ..... 198/671
4,926,790 A 5/1990 Nash ..... 118/653
5,526,099 A * 6/1996 Katakabe ..... 399/258
5,655,193 A * 8/1997 Fujishiro et al. ..... 399/256
5,768,662 A * 6/1998 Sugihara et al. ..... 399/258 X

* cited by examiner

*Primary Examiner*—Fred L Braun
(74) *Attorney, Agent, or Firm*—Perman & Green, LLP

(57) ABSTRACT

A toner transport apparatus for electrographic printing machines that uses the distance between a toner storage container holding a supply of toner material and a developer housing to admix the toner with the developer. A first flexible auger transports the toner from the toner storage container to the developer housing and a second flexible auger transports some of the toner and developer from the developer housing back to the toner hopper where it is mixed with fresh toner.

2 Claims, 2 Drawing Sheets

FIG. 1
PRIOR ART
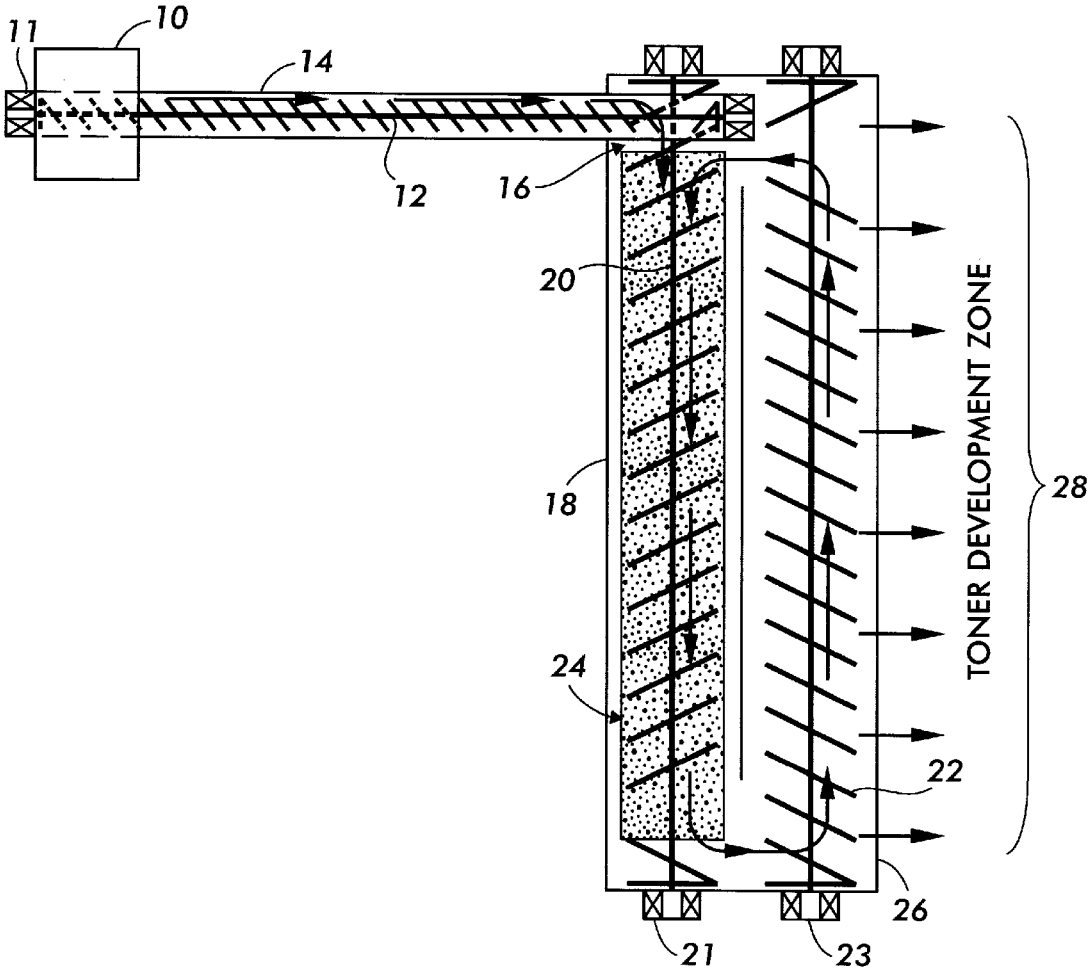
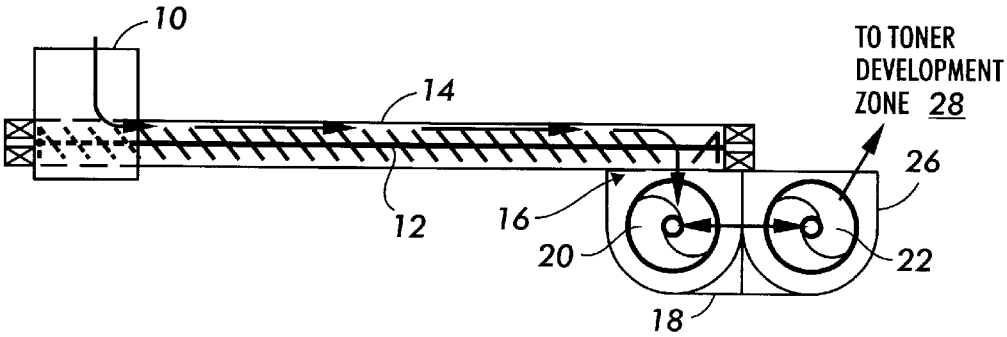
FIG. 2
PRIOR ART

FIG. 3
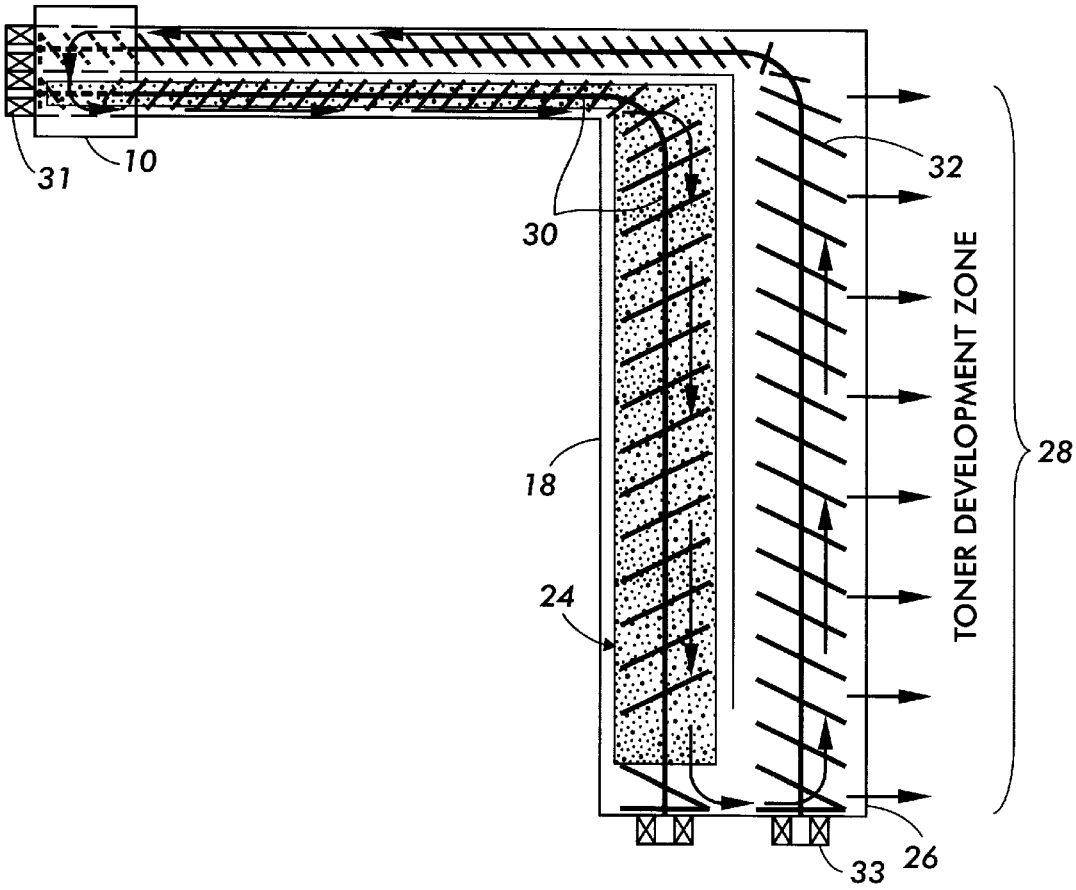
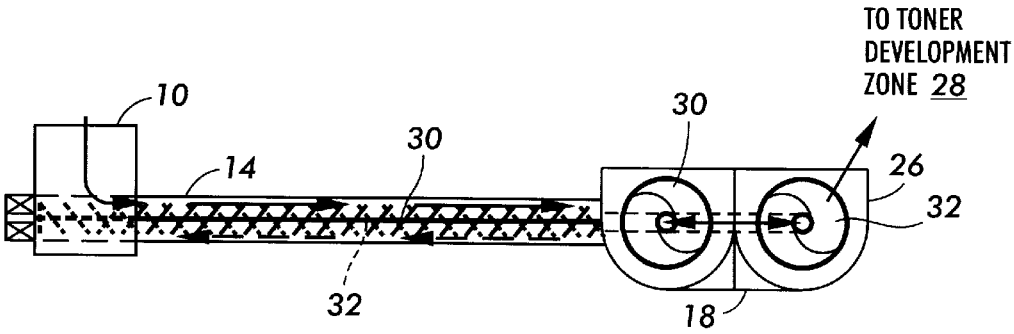
FIG. 4

TONER TRANSPORT APPARATUS USING FLEXIBLE AUGERS

BACKGROUND OF THE INVENTION

1. Field of the Invention

The present invention relates to electrophotographic printing apparatus, and more particularly, to apparatus for transporting toner material to a development zone.

2. Prior Art

References that disclose auger mechanisms for transporting toner material include U.S. Pat. No. 4,813,531 issued Mar. 21, 1989 to Tannascoli et al., entitled DEVELOPER TRANSPORT APPARATUS, U.S. Pat. No. 4,926,790 issued May 22, 1990 to Nash, entitled AUGER UNIT, U.S. Pat. No. 4,163,614 issued Aug. 7, 1979 to Vock discloses an auger system for transporting toner material using a flexible rotating helical member to advance the toner particles.

SUMMARY OF THE INVENTION

With high speed electrographic printing machines there is often very little time available between the moment when uncharged toner from the toner hopper enters the development housing and the first time it reaches the development housing zone where it is required to be well charged. On the other hand, the distance between the toner hopper and the development housing is typically quite far for both architectural and customer convenience reasons.

Another object of the present invention provide a toner transport apparatus that uses the distance between the toner hopper and the developer housing to premix the toner with the developer, by augering some of the developer up to the toner hopper and start to mix the toner and developer at that point.

An object of the present invention is to provide a toner transport apparatus that allows more time for toner charging and ease the charging rate requirements on the toner itself.

BRIEF DESCRIPTION OF THE DRAWINGS

FIG. 1 and FIG. 2 are schematic illustrations of a top view and a front side view respectively of an embodiment of a toner transport apparatus according to the prior art.

FIG. 3 and FIG. 4 are schematic illustrations of a top view and a front side view respectively of an embodiment of a toner transport apparatus according to the principles of the present invention.

DETAILED DESCRIPTION OF THE PREFERRED EMBODIMENT

Referring to FIG. 1 and FIG. 2, a top view and side view respectively is shown illustrating apparatus used in the development process in an electrophotographic printing apparatus as is known in the prior art.

In FIG. 1 and FIG. 2, toner material is stored in toner hopper 10 and is moved in a direction indicated by arrows by a rotating transport auger 12 driven by drive motor 11. Auger 12 is contained in auger chamber 14 and delivers the toner to a dispense point 16. At the dispense point 16 the toner is entered into developer housing 18 that contains a rotating mixing shaft 20.

Mixing shaft 20 is rotated by drive motor 21 and conveys and agitates the toner in order to admix or charge it within an admix zone indicated by the shaded area 24. The charged toner is then conveyed by rotating transport auger 22 to region 26 of developer housing 18 where it is dispensed to a toner development zone 28.

The toner and developer in region 26 is then transported back into admix zone 24 by auger 22 rotated by drive motor 23. With high speed machines there is very little time between the moment when uncharged toner enters the developer housing 18 and the first time it reaches the development zone 28 where it is required to be well charged. The toner hopper 10 is, because of design constraints, typically located a large distance from developer housing 18.

In the present invention, a toner transport apparatus is provided wherein the large distance between the toner hopper and the developer housing is used to premix the toner with the developer. This is accomplished by augering some of the developer up to the toner hopper at which point the toner can begin to mix with the developer.

Referring to FIGS. 3 and 4, top and front side views of an embodiment of the present invention are illustrated.

In FIG. 3, a first, flexible auger 30 rotated by drive motor 31 is used to transport the toner from the toner hopper 10 into developer housing 18 where it is agitated and admix as described with respect to FIG. 1 and FIG. 2.

The admixed toner is then transported by rotating auger 30 into region 26 where it is dispensed to a toner development zone 28.

Another flexible auger 32 rotated by drive motor 33 then transports the toner and developer back into toner hopper 10. Since developer is dispensed into the toner at hopper 10, the fresh toner being transported from toner hopper 10 to developer housing 18 is therefore being admixed along the transport distance, thus increasing the time the toner is admixed in the apparatus.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A toner transport apparatus for electrographic printing comprising:

a toner container for holding and dispensing a supply of toner material, a developer housing located at a given distance from the toner container, a first flexible length of auger mechanism having one end proximate to the toner container for transporting toner material from the toner container into a first region of the developer housing, the first region of the developer housing including a developer material and a toner agitating device to admix and charge the toner material and the developer material in the first region of the developer housing, the first flexible auger mechanism further transporting the charged toner material into a second region of the developer housing where the charged toner is dispensed to a toner development zone, a second auger mechanism for transporting toner material and developer material from the second region of the developer housing back to the toner container and depositing the toner material and the developer material from the second region of the developer housing directly into the toner container wherein the toner material and the developer material are admixed and charged while being transported from the second region of the developer housing back along the given distance to the toner container by the second auger.

2. A toner transport apparatus for electrographic printing according to claim 1 wherein the first and second auger mechanisms include first and second lengths of flexible auger shafts having helically wound members connected to the shafts for transporting the toner material and the admixed toner and developer material.

* * * * *